United States Patent [19]

Russell et al.

[11] Patent Number: 5,044,559

[45] Date of Patent: Sep. 3, 1991

[54] GAS ASSISTED LIQUID ATOMIZER

[75] Inventors: Sid Russell, Suffield; Richard S. Tuthill, Bolton, both of Conn.

[73] Assignee: United Technologies Corporation, Hartford, Conn.

[21] Appl. No.: 266,033

[22] Filed: Nov. 2, 1988

[51] Int. Cl.[5] ..... B05B 7/10

[52] U.S. Cl. ..... 239/406; 239/419.5; 239/424

[58] Field of Search ..... 239/405, 406, 419, 419.5, 239/423, 424, 427.3

[56] References Cited

U.S. PATENT DOCUMENTS

| | | | |
|---|---|---|---|
| 3,531,050 | 9/1970 | Abraham et al. | 239/427.3 |
| 4,139,157 | 2/1979 | Simmons | 239/400 |
| 4,600,151 | 7/1986 | Bradley | 239/406 |
| 4,609,150 | 9/1986 | Pane, Jr. et al. | 239/406 |
| 4,754,922 | 7/1988 | Halvorsen et al. | 239/5 |

*Primary Examiner*—Andres Kashnikow
*Assistant Examiner*—Karen B. Merritt
*Attorney, Agent, or Firm*—Troxell K. Snyder

[57] ABSTRACT

An atomizer having a central gas discharge conduit (112) and an annular, coaxial liquid conduit (120) includes a surrounding, annular liquid discharge opening (122) disposed immediately downstream of the gas discharge opening (116). A sized outlet orifice (131) is provided for discharging the comingled gas and liquid from the nozzle, with the orifice area (131) being sized no greater than the gas discharge opening (116).

4 Claims, 3 Drawing Sheets

GAS ASSISTED LIQUID ATOMIZER

FIELD OF THE INVENTION

The present invention relates to a liquid atomizer wherein coaxially central and outer streams of gas disperse an annular stream of liquid.

BACKGROUND

Gas assisted liquid atomizers, often termed "airblast nozzles", are well known means for dispersing a stream of liquid, such as a liquid fuel, in a stream of gas, such as air. Airblast fuel nozzles are common in gas turbine engine applications wherein it is desired to achieve rapid dispersion and combustion of the liquid fuel in a confined combustor volume.

U.S. Pat. No. 4,139,157 issued on Feb. 13, 1979 to Simmons shows an airblast fuel nozzle wherein successive coaxial flows of air, fuel, and additional air are combined and comingled so as to achieve the desired rapid dispersion and atomization of the liquid fuel. The Simmons disclosure recites very specific diametral relationships between the coaxially central airstream, the annular fuel stream, and the annular additional airflow in order to achieve maximum dispersion of the liquid fuel.

More specifically, Simmons states that the discharge opening for the axially central airstream must be less than the ultimate diameter of the annular fuel stream by an amount at least equivalent to the radial thickness of the annular fuel stream at maximum fuel flow. The disclosure of Simmons is typical of prior art airblast fuel nozzles wherein the initial discharge of the central pressurized gas stream is smaller in diameter than the outside diameter of the discharge opening of the concentric annular fuel stream.

Such prior art airblast nozzles, while effective in dispersing the liquid fuel, experience a significant drawback if the central gas discharge opening and the annular fuel discharge opening should for any reason be subject to a non-concentricity or other misalignment. Test results have established that even a slight variation in the concentricity of the central air and annular fuel discharge openings can result in a major non-uniformity in the mass flow of the dispersed fuel downstream of the nozzle. Such non-uniformities are especially undesirable in high performance gas turbine engines, frequently resulting in a localized overheating of the combustor liner, turbine vanes, or other structure, reducing service life and possibly degrading overall combustor and turbine durability and performance.

For example, in a typical airblast fuel atomizer having a radial thickness of the annular fuel stream on the order of 0.040 inches (0.100 cm), a non-concentricity between the central air discharge opening and the outer diameter of the annular fuel discharge opening of 0.004 inches (0.010 cm) result in an unacceptably high imbalance of the dispersed fuel. For such nozzles a typical acceptance tolerance of no more than 0.001 to 0.002 inches (0.003–0.005 cm) is necessary to insure uniform fuel dispersion. As will be familiar to those skilled in the art, such tolerances are difficult and expensive to maintain, especially in cast or welded nozzle structures.

What is needed is a fuel nozzle which is able to achieve satisfactory dispersion of a liquid and which is relatively insensitive to non-concentricity between the central gas discharge opening and the downstream annular fuel discharge opening.

SUMMARY OF THE INVENTION

It is therefore an object of the present invention to provide a gas assisted liquid atomizer.

It is further an object of the present invention to provide a gas assisted atomizer nozzle which is adapted to achieve a circumferentially uniform dispersion of the liquid.

It is still further an object of the present invention to provide an airblast type liquid atomizer which is relatively insensitive to any non-concentricity between the gas and liquid outlets.

According to the present invention, a gas assisted atomizer is provided with a central, gas discharge opening for exhausting a high velocity stream of atomizing gas, such as air, and a surrounding, annular stream of a liquid, such as fuel.

The present invention avoids the sensitivity to any non-concentricity between the outer diameter of the annular fuel stream and the gas outlet opening by sizing the lip of the fuel discharge opening no greater than the gas discharge opening, thereby insuring the comingling of the discharged gas and annular fuel stream before exiting the nozzle.

By directing the atomizing gas into the annular liquid stream while it is still confined within the nozzle, the atomizer according to the present invention reduces the sensitivity of the uniformity of the discharged liquid cloud to any non-concentricity or other positional misalignment which may be present in the structure of the atomizer nozzle. The more even distribution of the atomized liquid prevents, in the case of a gas turbine engine combustor, localized overheating of the downstream combustion chamber and turbine structures.

Both these and other objects and advantages of the present invention will be apparent to those skilled in the art upon review of the following detailed description and the appended claims and drawing figures.

DETAILED DESCRIPTION OF THE INVENTION

Figure 1:
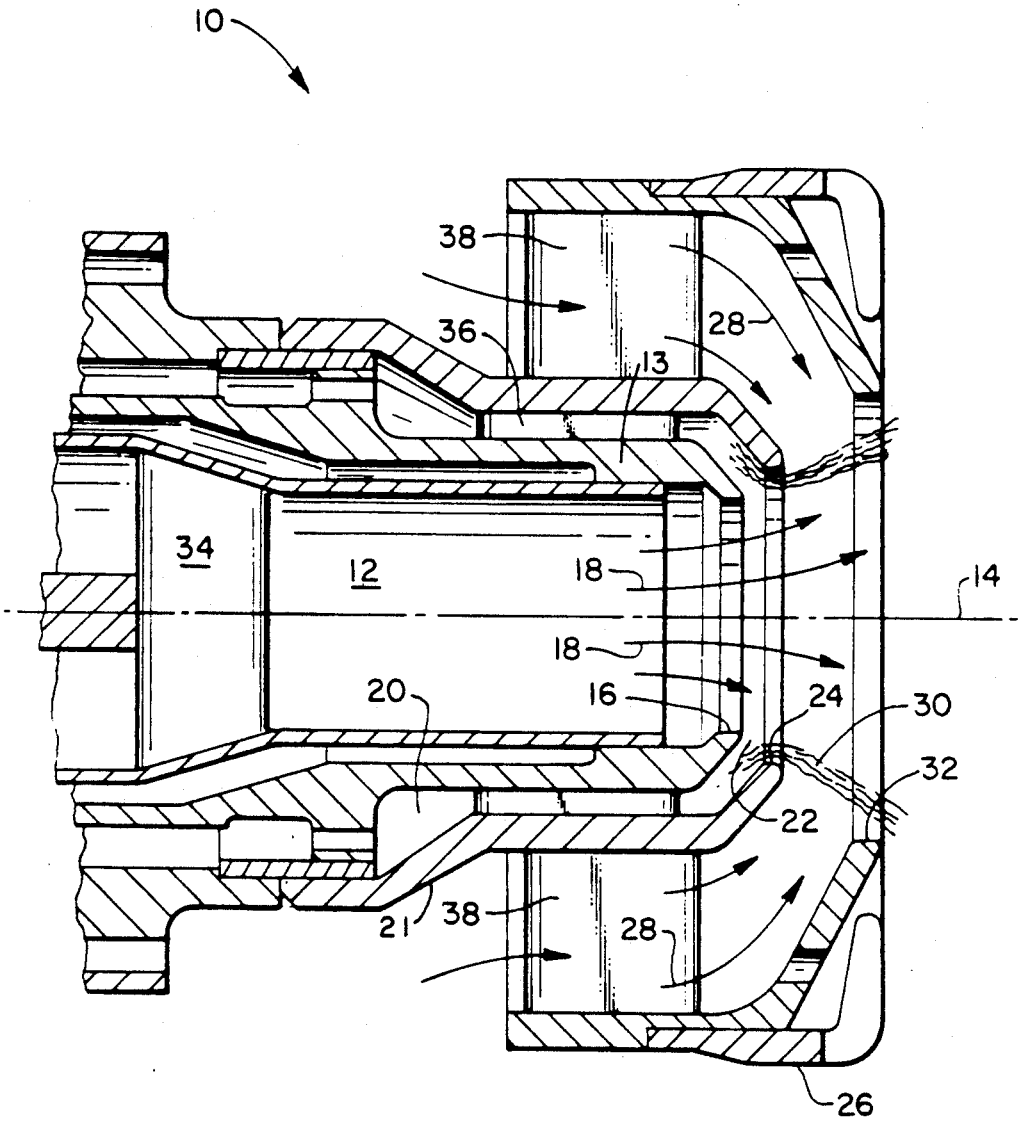
FIG. 1 PRIOR ART
FIG. 1 shows a prior art airblast fuel nozzle.

FIG. 1 shows a prior art airblast nozzle 10 having a central conduit 12 disposed along the nozzle axis 14 and having a discharge opening 16 through which the atomizing air 18 is discharged from the nozzle. Surrounding the first air opening 16 is an annular fuel supply passage 20 having an annular discharge opening 22 defined between the central air conduit 12 and the fuel and air outlet lip or orifice 24. A surrounding secondary nozzle ring 26 channels secondary atomizing air 28 coaxially about the annular fuel stream 30 with all three streams being discharged through the nozzle ring opening 32.

Primary air swirl vanes 34, liquid fuel swirl vanes 36, and secondary air swirl vanes 38 are also provided in the nozzle of FIG. 1 to increase the angular momentum of the various streams, thereby enhancing dispersion of the liquid stream 30 as is well known in the art.

Consistent with prior art practice, the nozzle as shown in FIG. 1 includes a central, or primary, air opening 16 having a diameter less than the outside diameter of the annular fuel discharge opening 22. This outside diameter, equivalent to the atomizer outlet orifice lip 24, allows the annular liquid or fuel stream 30 to expand radially outward with respect to the central nozzle axis 14 as the fuel 30 flows over the discharge lip 24. The primary air stream 18 thus flows parallel with the annular liquid stream 30, at least in the vicinity of the outlet lip 24.

As has been described above, a small misalignment between the primary air discharge opening 16 and the fuel discharge opening 22 can result in a serious circumferential non-uniformity of the dispersed liquid exiting the nozzle opening 32. It is believed this imbalance results from the rapid thinning of the annular liquid stream 30 as it flows over the outlet lip 24 and spreads radially outward with respect to the nozzle central axis 14 due to centrifugal force induced by the swirling of the liquid. The thin liquid film is disrupted more dramatically by a slight misalignment of the central air stream 18 caused by non-concentricity of the central air or gas opening 16. Although the thickness of the annular liquid stream 30 may vary with liquid flow rate, the negative effects in a gas turbine engine combustor are most notable when the fuel atomizer is operating at its highest rated capacity and hence thermal output.

Misalignment of the air and fuel openings 16, 22 in a fuel nozzle can be the result of a variety of factors, but is most frequently the result of the nozzle manufacturing process wherein the outer nozzle barrel 21 is welded to the primary air conduit 13. The localized heating of these relatively thin, lightweight components may raise a local deformity which can slightly alter the concentricity of the openings 16, 22. As noted above, even a slight misalignment can seriously impact discharge uniformity.

Figure 2:
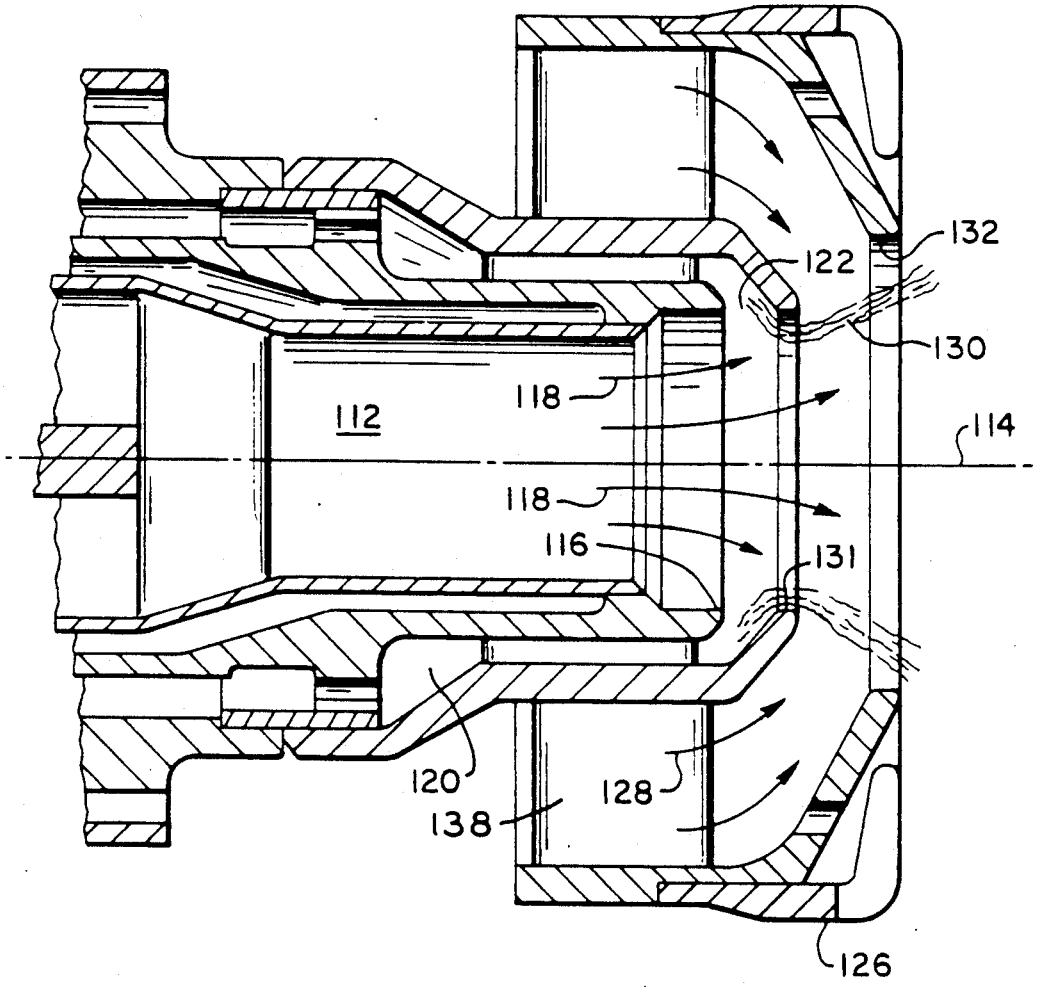
FIG. 2 shows a cross section of an atomizer according to the present invention.
Figure 3:
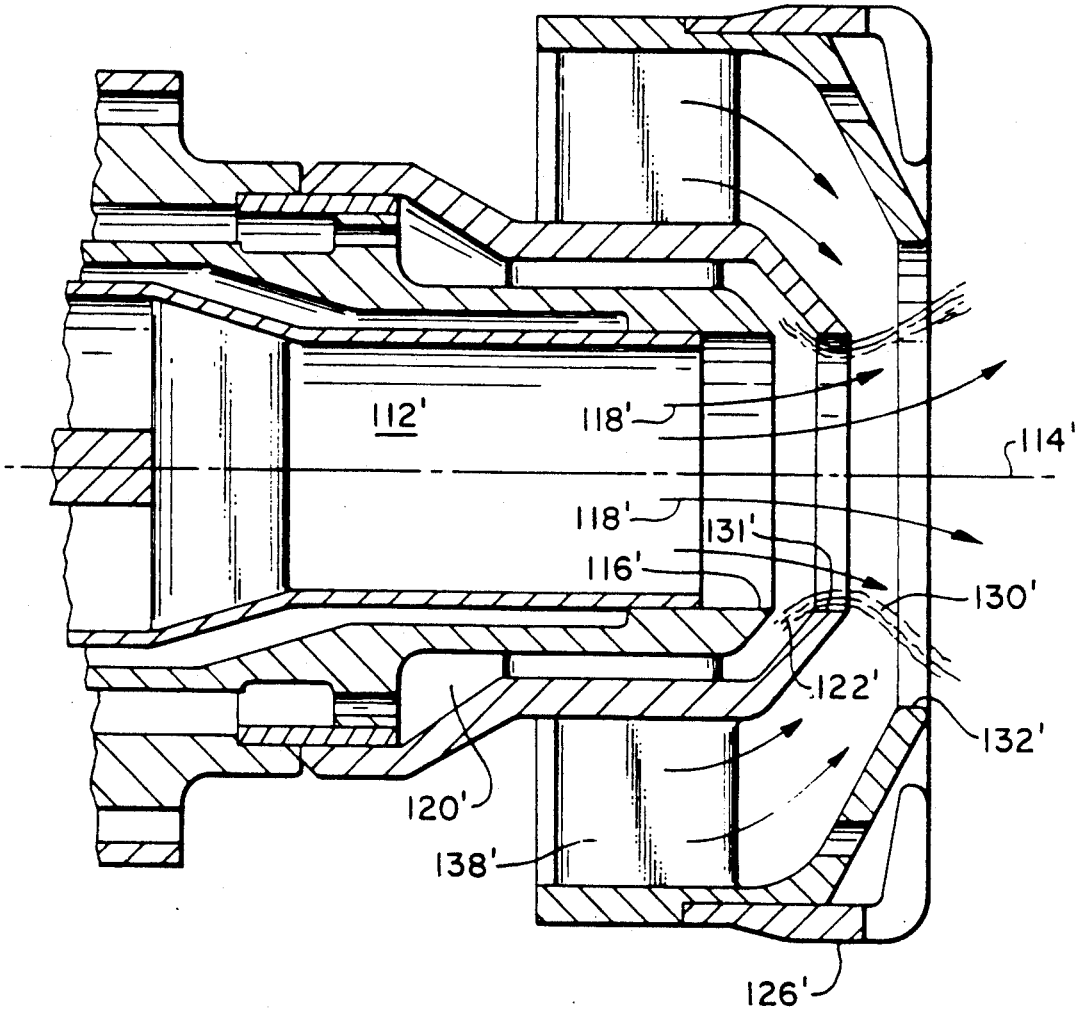
FIG. 3 shows a cross section of an alternate embodiment of an atomizer according to the present invention.

FIGS. 2 and 3 show an atomizer according to the present invention in two embodiments. FIG. 2 represents a modified prior art nozzle, while FIG. 3 shows a nozzle designed initially according to the present invention. As with the prior art nozzles, a central gas conduit 112 discharges a stream of primary or central air 118 coaxially with respect to the central nozzle axis 114. An annular fuel conduit 120, 120' in both embodiments discharges the liquid fuel through an annular opening 122, 122' immediately adjacent the central gas discharge opening 116, 116'.

As will be readily apparent from FIGS. 2 and 3, the maximum diameter of the annular liquid discharge openings 122, 122' are no greater than the diameter of the central gas discharge openings 116, 116'. Hence, the annular fuel stream 130, 130' discharged from the annular opening 122, 122' encounters the discharged air stream 118 prior to any expansion of the gas stream 118. Likewise, the annular fuel film 130, 130' encounters the central or primary gas stream 118 while still relatively thick as compared to the prior art stream 30 shown in FIG. 1. The comingling of the primary air 118 and the liquid 130, 130' reduces the sensitivity of the atomizer nozzle according to the present invention to any non-concentricity between the gas discharge opening 116, 116' and the corresponding circular outlet lip or orifice 131, 131'. Test results have shown nozzles configured according to the present invention, either designed initially to have the diameter of the air discharge opening 116' no less than the diameter of the outlet lip 131' or prior art nozzles wherein the gas discharge opening 116 is resized as shown in FIG. 2 to the same diameter as the outlet lip 131, to have vastly improved liquid dispersion symmetry and uniformity about the nozzle axis 114. In one test a prior art nozzle having an unacceptably high local variation in circumferential fuel dispersion was reconfigured according to the present invention, achieving nearly a 50% reduction in asymmetry in the most fuel rich octant, as well as achieving an overall acceptable nozzle dispersion symmetry.

The nozzle according to the present invention also includes a surrounding nozzle ring 126, 126' with swirl vanes 138, 138' as in the prior art.

It is thus apparent that the atomizer nozzle according to the present invention is well suited to achieve the objects and advantages as set forth hereinabove. It will further be appreciated that the nozzle, disclosed and described in two embodiments representative thereof, is nonetheless limited only by the language of the claims appearing hereinbelow.

We claim:

1. In a single stage liquid atomizer having a central gas discharge opening surrounded by a coaxial liquid discharge opening, wherein the gas discharge opening is disposed upstream of the liquid discharge opening and wherein the liquid and gas are both discharged from an atomizer outlet opening disposed downstream of the liquid outlet opening, the improvement comprising:

sizing the atomizer outlet opening no greater than the gas discharge opening, whereby the liquid and gas are commingled prior to exiting the atomizer.

2. The atomizer as recited in claim 1 wherein:

the gas discharge opening and atomizer opening are circular and the liquid discharge opening is annular.

3. A single stage liquid atomizer, comprising:

a central gas discharge conduit having an opening for discharging a stream of pressurized gas therefrom, and annular liquid conduit disposed around the gas discharge conduit, the liquid conduit ending in an annular opening adjacent the gas discharge opening and means, disposed downstream of the gas discharge conduit opening and the annular liquid conduit opening, for radially intermingling the liquid and gas streams prior to discharge from the atomizer, wherein the intermingling means is a sized outlet orifice disposed downstream of the liquid conduit opening and the gas discharge opening, said orifice being sized to achieve a flow area less than the combined flow areas of the gas discharge opening and the liquid conduit opening.

4. The atomizer is recited in claim 3, wherein the flow area of the sized orifice is no greater than the flow area of the gas discharge conduit opening.

* * * * *